United States Patent [19]

Hess

[11] 4,162,580

[45] Jul. 31, 1979

[54] WIG DRYING ATTACHMENT FOR HAIR DRYERS

[76] Inventor: Georgia E. Hess, 910 N. Madison St., Benton, Ill. 62812

[21] Appl. No.: 828,873

[22] Filed: Aug. 29, 1977

[51] Int. Cl.[2] ..... F26B 25/00

[52] U.S. Cl. ..... 34/103; 34/239; 248/226.4

[58] Field of Search ..... 34/103, 90, 239; 248/226.4

[56] References Cited

U.S. PATENT DOCUMENTS

| | | | |
|---|---|---|---|
| 467,328 | 1/1892 | Eichenberg | 248/226.4 |
| 1,789,815 | 1/1931 | Hanley | 248/226.4 |
| 3,320,681 | 5/1967 | Watlington | 34/103 |
| 3,376,656 | 4/1968 | Cavallo | 34/103 |
| 3,697,033 | 10/1972 | Jacobs | 248/226.4 |
| 3,757,429 | 9/1973 | Sumino | 34/103 |
| 3,958,340 | 5/1976 | Meyers | 34/103 |

*Primary Examiner*—Carlton R. Croyle
*Assistant Examiner*—Richard E. Gluck
*Attorney, Agent, or Firm*—Robert D. Farkas

[57] ABSTRACT

A wig drying attachment for hair dryers including a planar sheet having a substantially U-shaped portion which encircles and clamps to a vertical portion of a hair dryer such as the hot air inlet or the like, an arm integral with the U-shaped portion and radiating therefrom, and means for removably securing a wig support to the free end of the elongated arm. When the attachment is in use, the arm is positioned directly below the bonnet of a hair dryer. The wig support is a solid body having a plurality of elongated passageways therethrough communicating with the exterior surface of the wig support and a rod secured to the arm.

4 Claims, 3 Drawing Figures

WIG DRYING ATTACHMENT FOR HAIR DRYERS

BACKGROUND OF THE INVENTION

1. Field of the Invention

The present invention relates to wig drying attachments, and more particularly, to a wig drying attachment for use in conjunction with a hair dryer.

2. Description of the Prior Art

The prior art abounds with wig support assemblies which are designed to be clamped to a surface. These assemblies have been configured so that they may be clamped to the edge of a table, shelf, or the like. However, the use of presently known wig supports requires the user to direct a hand held hair dryer toward the wig maintained upon the support to effect drying thereof.

While some drying has been possible with bonnet type hair dryers that are portable, the prior art is devoid of any apparatus which may be used in conjunction with a permanently installed bonnet dryer as is customarily found in a beauty shop.

Typical of the apparatuses presently known in the wig support arts are those disclosed in U.S. Pat. Nos. 3,448,957, 3,586,281, and 3,591,118. It can be easily observed that these apparatuses are intended for use with a flat surface such as a table or shelf and cannot be easily adapted for use with a permanently installed bonnet type hair dryer that is fixed in position above a chair.

The present invention overcomes the problems associated with the prior art by providing a wig drying attachment which may be used in conjunction with permanently installed bonnet type hair dryers and does not require clamping to a support such as a table, shelf, or the like.

SUMMARY OF THE INVENTION

Therefore, a primary object of the present invention is to provide a wig drying attachment for use in conjunction with bonnet type hair dryers.

A further object of the present invention is to provide a wig drying attachment for hair dryers which is ideally suited for use with permanently installed bonnet type hair dryers that are disposed over chairs or the like.

A still further object of the present invention is to provide a wig drying attachment for hair dryers which does not depend on an external surface such as a table, shelf, or the like for affixment beneath the bonnet of the hair dryer.

Still another object of the present invention is to provide a wig drying attachment for hair dryers which may be quickly and easily engaged and disengaged from a hair dryer as desired by the user.

Still another further object of the present invention is to provide a wig drying attachment for hair dryers which may be manufactured from a single planar sheet at an inexpensive cost.

Another object of the present invention is to provide a wig drying attachment for hair dryers which is simple in design, and durable.

These objects, as well as further objects and advantages, of the present invention will become readily apparent after reading the description of a non-limiting illustrative embodiment and the accompanying drawing.

A wig drying attachment for hair dryers according to the principles of the present invention includes a planar sheet having a substantially U-shaped portion and an elongated arm portion integral with and radiating from the U-shaped portion, the U-shaped portion adapted to engage and partially encircle a portion of the hair dryer; means for clamping the U-shaped portion about the portion of the hair dryer; and means for removeably securing a wig support to the free end of the elongated arm.

BRIEF DESCRIPTION OF THE DRAWING

In order that the present invention may be more fully understood it will now be described, by way of example, with reference to the accompanying drawing in which.

DESCRIPTION OF THE PREFERRED EMBODIMENT

Figure 1:
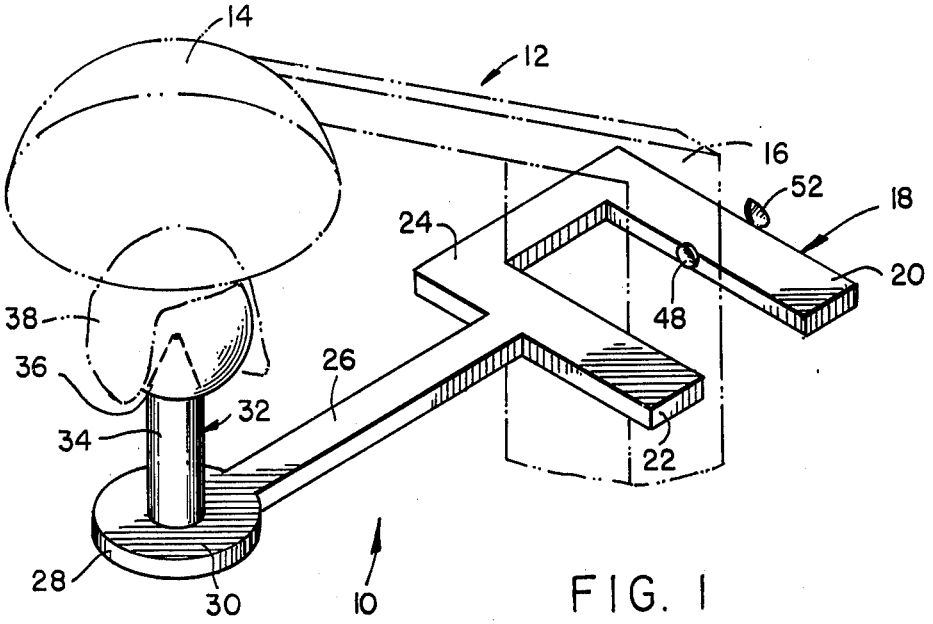
FIG. 1 is a perspective view of the preferred embodiment incorporating the principles of the present invention therein in use with a bonnet type hair dryer.
Figure 2:
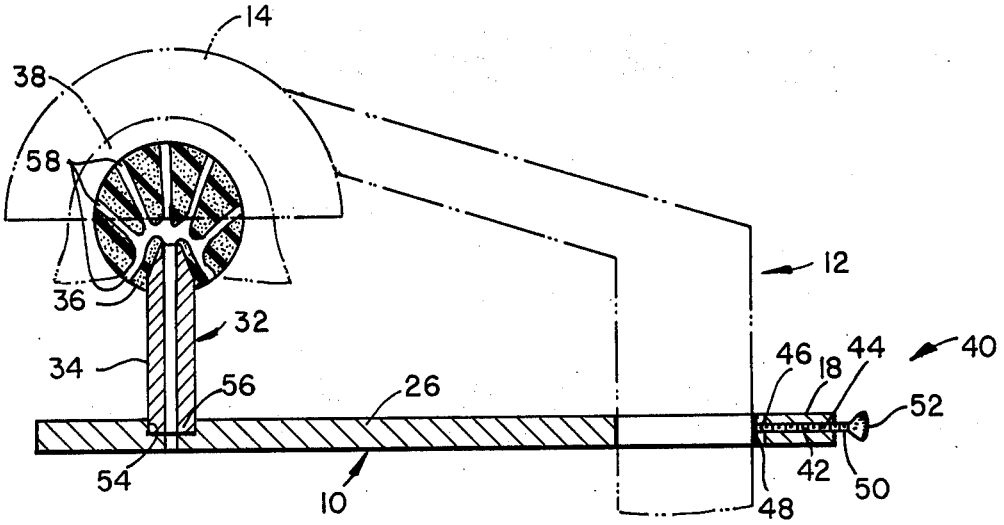
FIG. 2 is a cross-sectional view of the preferred embodiment as illustrated in FIG. 1.

Referring now to the figures, and more particularly to FIGS. 1 and 2 thereof, there is illustrated therein a wig drying attachment 10 in use in conjunction with a bonnet type hair dryer 12. The bonnet type hair dryer 12 includes a bonnet 14 and a support arm 16. The support arm 16 serves a dual function of supporting the bonnet 12 and serving as a hot air inlet which feeds heated air to the bonnet 14.

The wig drying attachment 10 is formed from a planar sheet and includes a substantially U-shaped portion 18. The U-shaped portion 18 includes a first leg 20, a second leg 22, and base 24. The wig drying attachment 10 provides an arm portion 26 which radiates from and is integrally formed with the second leg 22. The arm portion 26 is prefably centrally located in relation to the second leg 22 as illustrated. The free end 28 of the arm portion 26 terminates in a circular platform 30. The circular platform 30 has a wig support 32 secured thereto as hereinafter described.

The wig support 32 includes a rod 34 and a wig form 36. A wig 38 is disposed upon the wig form 36.

The U-shaped portion 18 is shown engaging the support arm 16 of the bonnet type hair dryer 12 with base 24 and first and second legs 20 and 22 of the U-shaped portion 18 in contact with the support arm 16. The U-shaped portion 18 is maintained in position about the support arm 16 by a clamp 40. The clamp 40 comprises a bolt 42 threadably disposed within an aperture 44 located through the first leg 20 of the U-shaped portion 18. The bolt 42 terminates on an end 46 thereof in a flat plate 48. The other end 50 of the bolt 42 is provided with a flattened head 52. When the flattened head 52 of the bolt 42 is turned the bolt 42 moves toward the support arm 16 and therefore presses the flat plate 48 thereagainst, clamping the wig drying attachment 10 to the bonnet type hair dryer 12. When the wig drying attachment 10 is clamped to the bonnet type hair dryer 12 as specified above, the wig support 32 and the wig 38 disposed thereon are positioned beneath the bonnet 14.

As most clearly illustrated in FIG. 2, the rod 34 of the wig support 32 is fixedly secured within an aperture 54 disposed in the arm portion 26 of the wig drying attachment 10. The aperture 54 in cooperation with a suitable adhesive retains the end 56 of the rod 34 therein. The rod 34 is preferably hollow as illustrated and the wig support 32 preferably is provided with a plurality of elongated openings 58 disposed therethrough. The elongated openings 58 are in communication with the hollow center portion of the rod 34 and with the aperture 54 thereby providing for circulation of air through the wig support 32 to speed drying of the wig 38. Alternately, the elongated openings 58 may pass through the wig support 32 and not be in communication with the hollow center portion of the rod 34.

Figure 3:
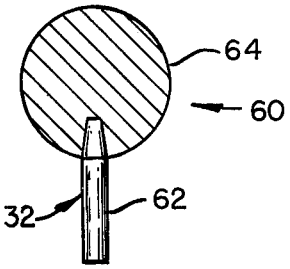
FIG. 3 is an alternate embodiment of the wig support of the present invention.

FIG. 3 illustrates an alternate embodiment of the wig support 32, a support 60. The wig support 60 includes a solid rod 62 and a solid wig form 64 removeable therefrom.

The wig drying attachment 10 may be constructed of any suitable material, such as wood, plastic, or the like. If non-heat drying is desired, the wig support 32 may be affixed to a square plate for support.

Therefore, a primary advantage of the present invention is to provide a wig drying attachment for use in conjunction with bonnet type hair dryers.

A further advantage of the present invention is to provide a wig drying attachment for hair dryers which is ideally suited for use with permanently installed bonnet type hair dryers that are disposed over chairs or the like.

A still further advantage of the present invention is to provide a wig drying attachment for hair dryers which does not depend on an external surface such as a table, shelf, or the like for affixment beneath the bonnet of the hair dryer.

Still another advantage of the present invention is to provide a wig drying attachment for hair dryers which may be quickly and easily engaged and disengaged from a hair dryer as desired by the user.

Still another further advantage of the present invention is to provide a wig drying attachment for hair dryers which may be manufactured from a single planar sheet at an inexpensive cost.

Another advantage of the present invention is to provide a wig drying attachment for hair dryers which is simple in design, and durable.

It will be understood that various changes in the details, materials, arrangements of parts and operation conditions which have been herein described and illustrated in order to explain the nature of the invention may be made by those skilled in the art within the principles and scope of the invention.

Having thus set forth the nature of the invention, what is claimed is:

1. A wig drying attachment for hair dryers comprising a planar sheet having a substantially U-shaped portion and an elongated arm portion integral with and radiating from said U-shaped portion, said U-shaped portion adapted to engage and partially encircle a portion of said hair dryer, means for clamping said U-shaped portion about said portion of said hair dryer, means for securing a wig support to the free end of said elongated arm, said means for securing including a hollow rod, said arm having an aperture disposed adjacent the free end thereof, said rod for securement on one end thereof to said arm, said one end of said rod communicating with said aperture, a solid wig form removeably secured to the other end of said rod, said wig form having a plurality of elongated openings therethrough, said openings being in communication with the interior of said rod and in communication with the exterior surface of said wig form.

2. A wig drying attachment in accordance with claim 1, wherein said U-shaped portion comprises a pair of leg portions and a base portion, said elongated arm being centrally located on and radiating from one of said leg portions.

3. A wig drying attachment in accordance with claim 2, wherein said clamping means comprises a bolt threadably disposed through an aperture located in the other of said pair of legs, said bolt moving toward said arm upon the tightening thereof.

4. A wig drying attachment in accordance with claim 1 wherein said other end of said rod is tapered on the exterior surface thereof.

* * * * *